United States Patent [19]

Tanck

[11] Patent Number: 4,555,437

[45] Date of Patent: Nov. 26, 1985

[54] TRANSPARENT INK JET RECORDING MEDIUM

[75] Inventor: Elinor J. Tanck, Cupertino, Calif.

[73] Assignee: Xidex Corporation, Sunnyvale, Calif.

[21] Appl. No.: 631,282

[22] Filed: Jul. 16, 1984

[51] Int. Cl.[4] ..... B41M 5/00

[52] U.S. Cl. ..... 428/212; 346/135.1; 427/146; 427/261; 428/195; 428/336; 428/481; 428/508; 428/532

[58] Field of Search ..... 346/1.1, 135.1; 400/126; 427/261, 288, 146; 428/207, 211, 537.5, 212, 236, 480, 481, 500, 508, 532, 195

[56] References Cited

U.S. PATENT DOCUMENTS

| | | | |
|---|---|---|---|
| 4,269,891 | 5/1981 | Minagawa | 346/135.1 |
| 4,446,174 | 5/1984 | Maekawa et al. | 346/135.1 |
| 4,460,637 | 7/1984 | Miyamoto et al. | 428/207 |
| 4,474,850 | 10/1984 | Burwasser | 346/135.1 |
| 4,478,910 | 10/1984 | Oshima et al. | 346/135.1 |

*Primary Examiner*—Bruce H. Hess

*Attorney, Agent, or Firm*—Townsend and Townsend

[57] ABSTRACT

A transparent recording medium comprised of a conventional transparency base material coated with hydroxyethylcellulose and optionally containing one or more additional polymers compatible therewith demonstrates unusually favorable properties for color ink jet recording by producing a clear transparent medium on which the ink dries rapidly to produce sharp images with minimal lateral bleed.

19 Claims, No Drawings

TRANSPARENT INK JET RECORDING MEDIUM

BACKGROUND OF THE INVENTION

1. Field of the Invention

The present invention relates to ink jet recording media, and particularly to transparent sheet materials capable of receiving images transferred by ink jet.

2. Description of the Prior Art

The preparation of transparencies for overhead projectors is generally done by electrostatographic copying and impact printing. These techniques, however, do not lend themselves to the direct recording of computer printouts, since most computers are designed for ink jet printing.

Regardless of the printing technique, it is important when printing on transparencies to produce clean sharp images which are rapidly absorbed into the print medium without bleeding. This need is particularly acute when color printing is desired, since color printing usually involves large amounts of ink per unit area and there is a greater frequency of having adjacent (contiguous) regions of different colors, such as in bar graphs, pie charts, maps with different colored regions, etc. It is important to keep the colors in such images separate. Due to its speed of application, ink jet printing has a particularly high tendency for adjacent regions of different colors to bleed into each other. To date, no satisfactory transparency medium has been produced which can accept ink jet printing without lateral bleeding.

SUMMARY OF THE INVENTION

It has now been discovered that a transparent recording medium having unusually favorable properties for ink jet recording, particularly with aqueous inks, is one comprised of a conventional transparency base material coated with hydroxyethylcellulose and optionally containing further additives, including other compatible polymers and miscellaneous ingredients to further enhance the ease in manufacture, handling and usage of the product. The result is a clear transparent medium on which the ink dries rapidly to produce sharp images with minimal bleed.

DESCRIPTION OF THE PREFERRED EMBODIMENTS

The critical component of the coating material is hydroxyethylcellulose, a commonly available commercial substance assuming a variety of forms. Specific types of hydroxyethylcellulose are generally defined by degree of molar substitution and the viscosity in the form of an aqueous solution of a given concentration. The molar substitution is defined as the average number of ethylene oxide molecules bound to each anhydroglucose group in the cellulose chain. For the purposes of the present invention, the degree of molar substitution is not critical and can vary widely. In general, however, materials having a molar substitution of from about 1.5 to about 3.0 are preferred. Likewise, the viscosity is not critical and can vary widely. It is normally expressed as a range, and for the purposes of the present invention, ranges falling within the overall range of about 20 to about 2000 centipoise (5% aqueous solution, 25° C.) are preferred, about 50 to about 500 particularly preferred.

Further benefit in terms of bleed resistance properties may be obtained by combining the hydroxyethylcellulose with one or more additional polymers which are compatible with the former in the sense of providing a uniform homogeneous solution and drying to a smooth, haze-free finish. Examples are polyacrylamides and polyvinylpyrrolidones. Preferred polyacrylamides are those which are nonionic or slightly anionic (i.e., a small portion of the amide groups having been hydrolyzed to anionic carboxyl groups). The molecular weight may vary widely, but is preferably less than about 3,000,000, and most preferably less than about 2,000,000. The amount will also vary widely, but will generally lie within the range of about 1% to about 25% (by weight, based on the finished coating), preferably from about 3% to about 15%. Preferred polyvinylpyrrolidones are those having a molecular weight within the range of from about 10,000 to about 700,000, while particularly preferred are those ranging from about 100,000 to about 500,000. Beneficial results with polyvinylpyrrolidones are seen over a somewhat broader range, generally from about 2% to about 70% by weight based on the finished coating, preferably from about 10% to about 50%.

The base material upon which the hydroxyethylcellulose is applied may be any conventional material used in transparency manufacture. Polyester film is a material widely used for this purpose. Preferred polyesters are sheet stable, biaxially oriented polyethylene terephthalates. Particularly preferred materials are those which have been surface-treated by the manufacturer to promote adhesion. The thickness of the film is not critical, but for most applications will generally range from about 0.5 to about 10 mil (0.0013 to 0.025 cm).

The hydroxyethylcellulose coating layer is applied to the base material according to conventional techniques. The most convenient involves first dissolving the resin in an appropriate solvent, organic or aqueous. Aqueous solutions are preferred. The concentration of the solution may vary widely provided that its viscosity is within a range sufficient to permit substantially uniform spreading. In general, solutions having a concentration ranging from about 1% to about 30% by weight, preferably from about 5% to about 15% by weight will provide the best results.

The application technique may be any of those generally known in the art of film or paper coating. Examples include roller coating, air knife coating, doctor blade coating, fountain coating or any other means by which substantially uniform application is achieved. Once the coating is applied, the film is permitted to dry thoroughly before use. This is readily done by exposure to air, preferably heated air.

The thickness of the coating layer itself is not critical and can vary over a wide range, although more favorable results in terms of ink reception are obtained as the thickness increases. In general, coating layers ranging from about 50 to about 1000 microinches (0.00013 to 0.0025 cm), preferably from about 250 to about 750 microinches (0.00064 to 0.0019 cm) will supply the best results.

As optional variations to the practice of the present invention, any of a variety of additives may be included in the coating composition for purposes of promoting ease of manufacture, handling and usage of the product. One example is particulate silica or other inorganic pigment to enhance non-blocking and slip properties by acting as a friction reducing agent. One or more surface active agents may also be included to enhance the spreadability of the coating solution. Examples are fluorocarbons and polyols. The resistance to ink bleed may further be enhanced by the addition of salts of sulfurous acid, notably sodium, potassium or ammonium bisulfite. Ultraviolet absorbers may also be included; a wide range of materials are known to be active for this purpose, notably salts of sulfonic acid. In addition, it is frequently beneficial to include materials which permit monitoring of the coating thickness such as, for example, a stilbene-2,2'-disulfonic acid. Finally, any of various known preservatives may be included to inhibit bacterial attack of the coating. Non-metallic organic compounds are particularly useful in this regard.

The need for these and other additives as well as the effective amounts will be readily apparent to those skilled in the art.

The following examples are offered for illustrative purposes and are intended neither to define nor limit the invention in any manner.

EXAMPLE 1

This example demonstrates the unusual effectiveness of hydroxyethylcellulose as a coating for receiving ink jet images, in comparison with other polymeric binders.

A series of binder resins were prepared as 10% aqueous solutions (weight basis) and between 0.1% and 0.4% of a fluorocarbon flow agent was added, based on the weight of each resin. Each solution was applied to one side of a 1.2 mil surface-treated polyethylene terephthalate film with a 4 mil knife applicator. The films where then dried in a circulating hot air oven. The resulting coating layers had thicknesses of 300 to 500 microinches. The solutions were then applied to the other side of the film and dried in like manner.

A series of contiguous color strips were then applied to each film by the use of a Tektronix No. 4691 ink jet printer (Tektronix, Inc. Beaverton, Oreg.), by simultaneous application of magneta, yellow and cyan inks to form a standard test pattern which included these three colors plus red, blue and green. The drying times of the inks were determined for each film coating, as well as the amount of spreading or bleeding between the red and yellow, red and blue, and blue and green bands. The results as shown in Table I below.

TABLE I

COATING COMPARISON TEST RESULTS

| Coating Material | Light Transmission | Ink Drying Time | Degree of Bleeding | General Film Appearance |
|---|---|---|---|---|
| Polyvinyl alcohol | transparent | 120 sec | substantial | smooth |
| Polyvinyl-pyrrolidone | transparent | 120 sec | minimal | became tacky |
| Poly-acrylamide | transparent | —[a] | —[a] warped | on standing wrinkled, |
| Poly-(N,N—dimethyl-acrylamide) | transparent | >180 sec | minimal | smooth |
| Hydroxy-propyl-cellulose | blotched | 105 sec | minimal | smooth |
| Carboxy-methyl-cellulose | transparent | <60 sec | moderate | wrinkled, warped; poor ink gloss |
| Hydroxy-ethyl starch | transparent | <60 sec | substan-tial | wrinkled, warped |
| Methyl-cellulose | transparent | instant | substan-tial | smooth |
| Hydroxy-ethyl-cellulose 2.0 M.S.[B] | transparent | <60 sec | minimal | smooth |
| Hydroxy-ethyl-cellulose 2.5 M.S.[B] | transparent | <60 sec | minimal | smooth |

[a]Not tested
[b]M.S. = molar substitution

The test results in this table clearly indicate that hydroxyethylcellulose is superior to all other resins tested.

EXAMPLE 2

This example demonstrates the effect of admixing hydroxyethylcellulose with additional polymers. The additional polymer in each test was added to the aqueous solution of hydroxyethylcellulose prior to application of the solution to the surface-treated polyethylene terephthalate base to form a film. The total concentration of polymer in each case was 10% by weight, except for Sample N where the polymer concentration was 5% by weight. In addition, 0.1% of a fluorocarbon flow agent was added to all solutions. The solutions were applied to both sides of the base with a 4 mil knife applicator and dried, and the various inks were applied and observed as in Example 1. The results are listed in Table II. The resulting film thicknesses after drying were 300–500 microinches for those where a 10% solution was applied and 200 microinches for Sample N. The percents given for the second polymer (additive) are based on the total polymer in the coating, and are by weight.

TABLE II

POLYMERS ADDED TO HYDROXYETHYLCELLULOSE AS COATING COMPOSITIONS

| Sample | Additive % | Light Transmission | Ink Drying Time | Degree of Bleeding | General Film Appearance |
|---|---|---|---|---|---|
| A | None | transparent | <60 sec | minimal | smooth |
| B | PVP K-90,20 | transparent | 90 sec | less than A | smooth |
| C | PVP K-90,30 | transparent | 90 sec | less than B | smooth |
| D | PVP K-90,50 | transparent | 90 sec | less than C | smooth |
| E | PVP K-60,50 | transparent | 150 sec | same as B | smooth |
| F | Cyanamer A-370,50 | very hazy | — | — | wrinkled |
| G | Cyanamer | hazy with | — | — | wrinkled |

TABLE II-continued

POLYMERS ADDED TO HYDROXYETHYLCELLULOSE AS COATING COMPOSITIONS

| Sample | Additive % | Light Transmission | Ink Drying Time | Degree of Bleeding | General Film Appearance |
|---|---|---|---|---|---|
| | A-370,25 | blotches | | | |
| H | Cyanamer P-26,50 | hazy | — | — | wrinkled |
| I | Cyanamer P-26,25 | slightly hazy | — | — | smooth |
| J | Cyanamer P-250,10 | very hazy | — | — | polymers incompatible |
| K | Separan 87D,50 | transparent | — | — | wrinkled |
| L | Separan 87D,25 | transparent | — | — | wrinkled |
| M | Separan 87D,10 | transparent | 60 sec | less than A | smooth |
| N | Separan NP10,10 (thinner coat) | transparent | >90 sec | more than A | smooth |
| O | Gantrez, M,10 | slightly hazy | — | substantial | smooth |
| P | None | transparent | >60 sec | minimal | smooth |
| Q | Separan 87D,10 | transparent | >60 sec | less than P | smooth |
| R | Separan 87D,25 | transparent | — | — | wrinkled |

PVP: Polyvinylpyrrolidone
K-90: average molecular weight 360,000
K-60: average molecular weight 160,000 products of GAF Corporation, New York, New York
Cyanamer A 370, P26 and P250: products of American Cyanamid Company, Wayne, New Jersey--
A370 defined as "modified polyacrylamide"with molecular weight of approximately 200,000 and "substantial carboxylate content"
P26 defined as "modified polyacrylamide"with molecular weight of approximately 200,000 and "minority carboxylate content"
P250 defined as "nomopolymer of acrylamide, "essentially non-ionic with a molecular weight of approximately 5 to 6 million
Separan 87D and NP10: products of Dow Chemical Company, Midland, Michigan
87D defined as "slightly anionic"polyacrylamide with molecular weight of approximately 500,000
NP10 defined as "nonionic"polyacrylamide with molecular weight of approximately 1.5 million
Gantrez M: polyvinyl methyl ether, product of GAF Corporation, New York, New York The hydroxyethylcellulose used in Samples A through O were Natrosol 250J and 250L, products of Hercules Inc., Wilmington, Del., each with molar substitution of 2.5; with viscosity ranges of 150–400 centipoise for 250J and 75–150 centipoise for 250L (Brookfield viscosity of 5% aqueous solution at 25° C.)

The hydroxyethylcellulose used in Samples P through R was Cellosize ®WP-09L, a product of Union Carbide Corporation, Danbury, Conn., with molar substitution of 2.0 and viscosity range of 75–112 centipoise (LVF Brookfield of 5% aqueous solution at 25° C.)

Dashes in the table indicate that observations were not taken.

The tabulated observations indicate that the addition of polyvinylpyrrolidone improved the bleed resistance in all cases, although some increase in ink drying time was observed. Comparison among the Cyanamer and Separan samples indicates that the lower molecular weight, nonionic or at most slightly anionic samples provided the best results, at concentrations of 25 weight percent (with respect to total resin) or below.

Samples M and Q were tested further by exposure at 38° C. to an atmosphere containing 80% relative humidity for one hour before application of the ink. In spite of such exposure, these samples displayed no increase in the degree of bleeding, no changes in ink shade colors and no change in light transmission over films prepared and printed identically without the humidity exposure.

The foregoing is offered primarily for purposes of illustration. It will be readily apparent to those skilled in the art that modifications of and variations from the materials and procedural steps disclosed above may be introduced without departing from the spirit and scope of the invention, as claimed in hereinbelow.

What is claimed is:

1. A transparent recording sheet comprising a transparent base support coated with a transparent ink-receiving layer comprising a hydroxyethylcellulose.

2. A transparent recording sheet according to claim 1 in which said hydroxyethylcellulose has a viscosity of from about 20 to about 2000 centipoise, measured as a 5 weight percent aqueous solution at 25° C. on a Brookfield viscometer.

3. A transparent recording sheet according to claim 1 in which said hydroxyethylcellulose has a viscosity of from about 50 to about 500 centipoise, measured as a 5 weight percent aqueous solution at 25° C. on a Brookfield viscometer, and a molar substitution of from about 1.5 to about 3.0.

4. A transparent recording sheet according to claim 1 in which said base support is a heat-stable biaxially oriented polyethylene terephthalate and the thickness of said ink-receiving layer is from about 50 to about 1000 microinches.

5. A transparent recording sheet according to claim 1 in which said ink-receiving layer further comprises at least one member selected from the group consisting of a polyacrylamide and a polyvinylpyrrolidone.

6. A transparent recording sheet according to claim 1 in which said ink-receiving layer further comprises from about 1% to about 25% by weight of a polyacrylamide at most slightly anionic in character with an average molecular weight of less than about three million.

7. A transparent recording sheet according to claim 1 in which said ink-receiving layer further comprises from about 3% to about 15% by weight of a polyacrylamide ranging from substantially non-ionic to slightly anionic in character with an average molecular weight of less than about two million.

8. A transparent recording sheet according to claim 1 in which said ink-receiving layer further comprises from about 2% to about 70% by weight of a polyvinylpyrrolidone with an average molecular weight of from about 10,000 to about 700,000.

9. A transparent recording sheet according to claim 1 in which said ink-receiving layer further comprises from about 10% to about 50% by weight of a polyvinylpyrrolidone with an average molecular weight of from about 100,000 to about 500,000.

10. A transparent recording sheet comprising (a) a transparent base support comprising a heat-stable biaxially oriented polyethylene terephthalate and (b) a transparent ink-receiving layer having a thickness of from about 250 to about 750 microinches and comprising hydroxyethylcellulose having a viscosity of from about 50 to about 500 centipoise, measured as a 5 weight percent aqueous solution at 25° C. on a Brookfield viscometer, and a molar substitution of from about 1.5 to about 3.0.

11. A transparent recording sheet comprising:

(a) a transparent base support comprising a heat-stable biaxially oriented polyethylene terephthalate; and (b) a transparent ink-receiving layer adherent to said base support, said layer having a thickness of from about 250 to about 750 microinches and comprising (i) hydroxyethylcellulose having a viscosity of from about 50 to about 500 centipoise, measured as a 5 weight percent aqueous solution at 25° C. on a Brookfield viscometer, and a molar substitution of from about 1.5 to about 3.0, and (ii) from about 3% to about 15% by weight of said layer of a polyacrylamide which is at most slightly anionic in character with an average molecular weight of less than about two million.

12. A method for the preparation of a transparent recording sheet comprising:

(a) applying to a transparent base support a layer of an aqueous solution of a hydroxyethylcellulose; and (b) evaporating water from said layer to provide a dry substantially uniform transparent layer of hydroxyethylcellulose.

13. A method according to claim 12 in which the concentration of said hydroxyethylcellulose in said aqueous solution is from about 1% to about 30% by weight, and said hydroxyethylcellulose has a viscosity of from about 20 to about 2000 centipoise, measured as a 5 weight percent aqueous solution at 25° C. on a Brookfield viscometer.

14. A method according to claim 12 in which the thickness of the layer of step (b) is from about 50 to about 1000 microinches.

15. A method according to claim 12 in which the concentration of said hydroxyethylcellulose in said aqueous solution is from about 5% to about 15% by weight, said hydroxyethylcellulose has a viscosity of from about 50 to about 500 centipoise, measured as a 5 weight percent aqueous solution at 25° C. on a Brookfield viscometer, and a molar substitution of from about 1.5 to about 3.0, and the thickness of the layer of step (b) is from about 250 to about 750 microinches.

16. A method according to claim 12 in which said aqeous solution of step (a) further contains at least one member selected from the group consisting of a polyacrylamide and a polyvinylpyrrolidone.

17. A method according to claim 12 in which said aqueous solution of step (a) further contains from about 1% to about 25% by weight, based on total dissolved solids, of a polyacrylamide ranging from substantially non-ionic to slightly anionic in character with an average molecular weight of less than about three million.

18. A method according to claim 12 in which said aqueous solution of step (a) further contains from about 2% to about 70% by weight of a polyvinylpyrrolidone with an average molecular weight of from about 10,000 to about 700,000.

19. A method according to claim 12 in which said base support of step (a) is a heat-stable biaxially oriented polyethylene terephthalate, said hydroxyethylcellulose has a viscosity of from about 50 to about 500 centipoise, measured as a 5 weight percent aqueous solution at 25° C. on a Brookfield viscometer, and a molar substitution of from about 1.5 to about 3.0, said aqueous solution further contains from about 3% to about 15%, based on total dissolved solids, of a polyacrylamide ranging from substantially non-ionic to slightly anionic in character with an average molecular weight of less than about two million, and the thickness of the layer of step (b) is from about 250 to about 750 microinches.

* * * * *